US009919904B2

(12) United States Patent
Gottschling et al.

(10) Patent No.: US 9,919,904 B2
(45) Date of Patent: Mar. 20, 2018

(54) BALANCER

(75) Inventors: Willi Gottschling, St. Gilgen (AT); Herbert Pinwinkler, Thalgau (AT); Gheorghe Stirbu-Blagut, Salzburg (AT)

(73) Assignee: Konecranes PLC, Hyvinkaa (FI)

( * ) Notice: Subject to any disclaimer, the term of this patent is extended or adjusted under 35 U.S.C. 154(b) by 0 days.

(21) Appl. No.: 14/122,921

(22) PCT Filed: May 25, 2012

(86) PCT No.: PCT/EP2012/002240

§ 371 (c)(1),
(2), (4) Date: Apr. 8, 2014

(87) PCT Pub. No.: WO2012/163505

PCT Pub. Date: Dec. 6, 2012

(65) Prior Publication Data

US 2015/0053903 A1 Feb. 26, 2015

(30) Foreign Application Priority Data

May 27, 2011 (DE) ..... 10 2011 103 320

(51) Int. Cl.
*B66D 5/04* (2006.01)
*B66D 3/18* (2006.01)
(Continued)

(52) U.S. Cl.
CPC ..... *B66D 5/04* (2013.01); *B66D 1/08* (2013.01); *B66D 3/18* (2013.01); *B66D 3/20* (2013.01)

(58) Field of Classification Search
CPC .... B66D 5/04; B66D 5/34; B66D 3/18; A62B 1/10
See application file for complete search history.

(56) References Cited

U.S. PATENT DOCUMENTS 1,515,985 A * 11/1924 Wright ..... 188/185
1,904,089 A * 4/1933 Schwerin ..... 188/185
(Continued)

FOREIGN PATENT DOCUMENTS

DE 1034424 B 7/1958
JP JUS48081280 A 1/1973
(Continued)

OTHER PUBLICATIONS

English translation of Japanese Office Action dated Jan. 28, 2015, received in related Japanese Application No. 2014-511776, 7 PGS.
(Continued)

*Primary Examiner* — Michael E Gallion
(74) *Attorney, Agent, or Firm* — Grossman TuckerPerreault & Pfleger, PLLC

(57) ABSTRACT

The invention relates to a balancer (1) for raising, holding and lowering a load, comprising a cable drum (7) which can be rotated in a manner actuated by pressure medium and has a cable for bearing the load, which cable can be unwound from and wound onto said cable drum (7), and has a device for emergency braking of the cable drum (7) if a defined rotational speed is exceeded, which device for emergency braking comprises at least one locking element (16) which is fastened to the cable drum (7), is held in a freewheeling position in a spring-loaded manner and can be moved into a deployed locking position in a manner which is actuated by centrifugal force, in which locking position the rotation of the cable drum (7) is blocked by virtue of the fact that the locking element (16) is in engagement with a stop which is stationary relative to the cable drum (7). The balancer (1) according to the invention is distinguished by the fact that, after its triggering, the locking element (16) is held in a deployed position when said locking element (16) and the stop which interacts with it move out of engagement.

18 Claims, 3 Drawing Sheets

Figure 1:
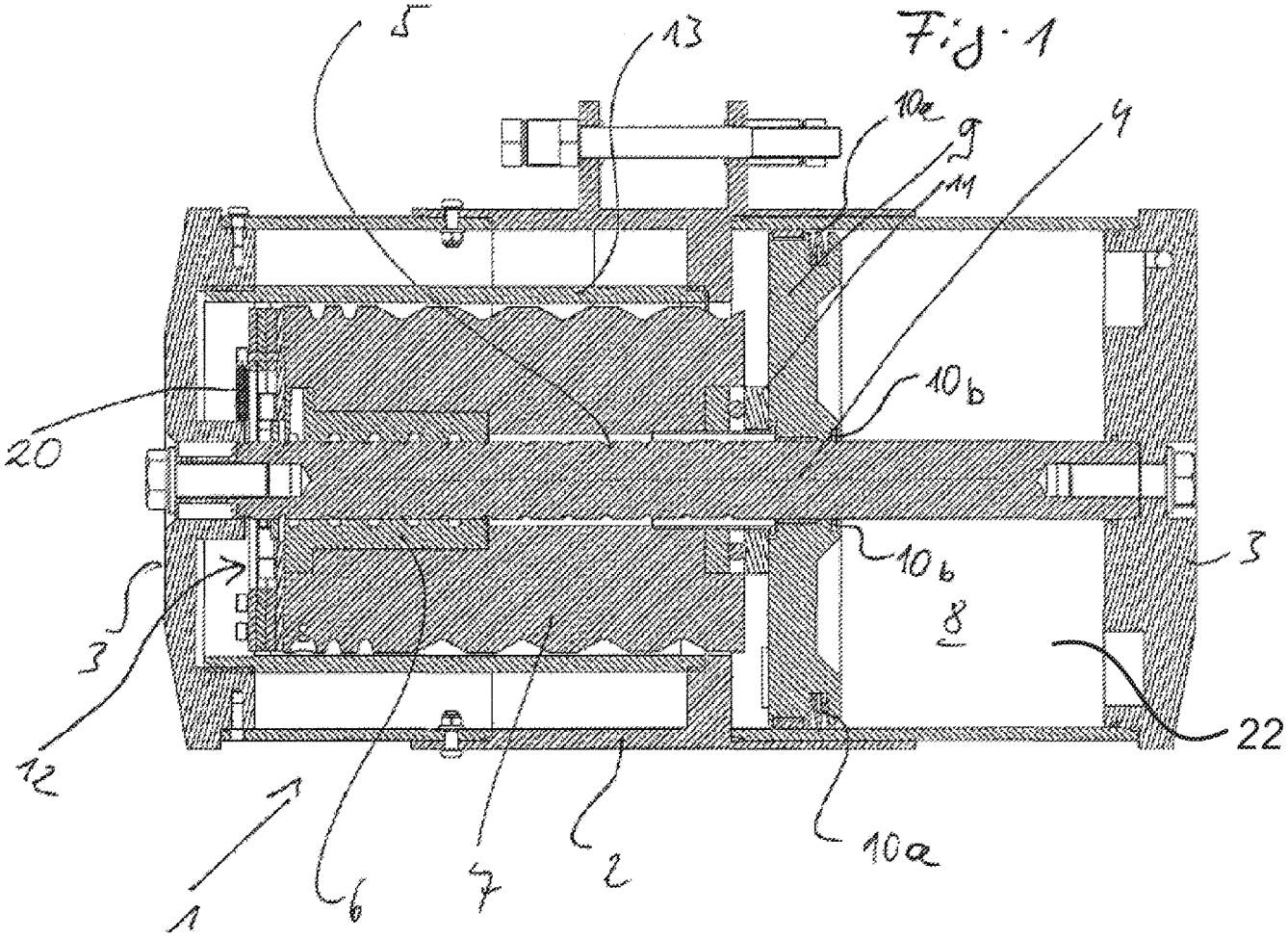

(51) Int. Cl.
*B66D 1/08* (2006.01)
*B66D 3/20* (2006.01)

(56) References Cited

U.S. PATENT DOCUMENTS

| | | | | | |
|---|---|---|---|---|---|
| 2,248,375 | A * | 7/1941 | Moore | 188/295 |
| 2,665,111 | A * | 1/1954 | Sokolik | 182/239 |
| 2,896,912 | A | 11/1956 | Faugier et al. | |
| 3,286,989 | A * | 11/1966 | Bangerter et al. | 254/331 |
| 3,333,821 | A * | 8/1967 | Deppner et al. | 254/378 |
| 3,526,388 | A | 9/1970 | Geiger et al. | |
| 3,602,483 | A * | 8/1971 | Russell et al. | 182/239 |
| 3,915,432 | A * | 10/1975 | Bustamante | 182/239 |
| 3,976,172 | A * | 8/1976 | F'Geppert | 192/223.1 |
| 4,448,290 | A * | 5/1984 | Reid et al. | 188/82.7 |
| 4,520,998 | A * | 6/1985 | Flaig | 254/267 |
| 5,522,581 | A * | 6/1996 | Kulhavy | 254/267 |
| 5,553,832 | A * | 9/1996 | Zaguroli, Jr. | 254/267 |
| 5,593,138 | A | 1/1997 | Zaguroli, Jr. | |
| 5,701,972 | A * | 12/1997 | Bloder | 182/234 |
| 5,848,781 | A * | 12/1998 | Kulhavy et al. | 254/360 |
| 6,279,682 | B1 * | 8/2001 | Feathers | 182/239 |
| 6,695,292 | B2 * | 2/2004 | Nam | 254/267 |
| 6,872,889 | B1 * | 3/2005 | Cruttenden et al. | 174/69 |
| 7,097,156 | B2 * | 8/2006 | Nam | 254/331 |
| 8,118,143 | B2 * | 2/2012 | Brandt | 188/184 |
| 8,317,161 | B2 * | 11/2012 | Fujii | 254/378 |
| 2001/0022358 | A1 | 9/2001 | Heun et al. | |
| 2001/0050168 | A1 * | 12/2001 | Hult | 166/68.5 |
| 2003/0047726 | A1 * | 3/2003 | Nam | 254/267 |
| 2005/0211965 | A1 * | 9/2005 | Nam | 254/331 |
| 2008/0142296 | A1 * | 6/2008 | Jean | 182/5 |
| 2009/0178887 | A1 * | 7/2009 | Reeves et al. | 182/239 |
| 2009/0223744 | A1 * | 9/2009 | Dowie | 182/234 |
| 2010/0108965 | A1 | 5/2010 | Fujii | |
| 2014/0048758 | A1 * | 2/2014 | Oland | 254/217 |
| 2015/0014613 | A1 * | 1/2015 | Horndacher et al. | 254/267 |

FOREIGN PATENT DOCUMENTS

| | | | |
|---|---|---|---|
| JP | 07008388 | U | 6/1996 |
| KR | 1020070070819 | A | 4/2007 |
| SU | 23576 | | 10/1931 |
| SU | 47062 | | 3/1936 |

OTHER PUBLICATIONS

PCT International Search Report and Written Opinion dated Sep. 27, 2012, received in corresponding PCT Patent Application No. PCT/EP12/02240, 9 pgs.

* cited by examiner 1
2
3
4
5
6
8
9
10a
10b
10b
10c
11
12
13
20
22

17
21
16
14
20
12

17
21
16
18
18

17
16
15
20

BALANCER

The invention relates to a balancer for raising, holding and lowering a load, comprising a cable drum which can be rotated in a manner actuated by pressure medium and has a cable for bearing the load, which cable can be unwound from and wound onto said cable drum, and has a device for emergency braking of the cable drum if a defined rotational speed is exceeded, which device for emergency braking comprises at least one locking element which is fastened to the cable drum, is held in a freewheeling position in a spring-loaded manner and can be moved into a deployed locking position in a manner which is actuated by centrifugal force, in which locking position the rotation of the cable drum is blocked by virtue of the fact that the locking element is in engagement with a stop which is stationary relative to the cable drum.

A balancer of this type is known, for example, from EP 1 136 423 A1. Said application describes a device for limiting the upper rotational speed of a balancing lifting gear (balancer), in particular for emergency braking of the lifting gear. The lifting gear comprises a threaded spindle which is rotationally mounted in a housing, can be rotated by means of a piston which can be longitudinally displaced pneumatically in the housing, and carries a cable drum, and also comprises a spindle nut which is connected fixedly to the housing, the cable drum which can be displaced longitudinally on the threaded spindle being connected fixedly thereto so as to rotate with it. The apparatus for emergency braking of the cable drum comprises a plurality of pawls which can be pivoted counter to an elastic retaining force, about a pivot pin which is parallel to the threaded spindle, from a radially inner rest position to an outer brake position, which pawls in each case point in the rotational direction when the cable drum rotates, and can be pivoted with their free end into the brake position in a manner which is loaded by centrifugal force, above a rotational speed which is predetermined by the magnitude of the retaining force. In the radially deployed brake position, the pawls engage into corresponding stops of an outer stopping element which is arranged in a fixed manner on the housing. The entire device for emergency braking of the cable drum is fastened to the threaded spindle on the end side of the latter via a type of slipping clutch. The rotation of the rotary spindle and therefore of the cable drum is stopped via a frictional connection between an inner cone and an outer cone if the pawls are moved radially to the outside about the pivot pins, counter to the retaining force of springs, and come into engagement with stop faces of the stopping element which are assigned to the pawls.

The device for emergency braking of the cable drum according to EP 1 136 423 A1 is configured in such a way that, when the drum is at a standstill and there is tension on the cable in the opposite direction, the pawls return automatically into their initial position.

A compressed air balancer with emergency brake/emergency braking means is also known, for example, from DE 103 44 24 B4. On said compressed air balancer, the device for emergency braking of the cable drum comprises at least one brake shoe which can be pivoted with the cable drum about a parallel to the drum axis, can be moved from a rest position into a brake position, and, in the brake position, forms a frictional connection with a stationary cylinder, at least one separate centrifugal element generating a moment above a defined rotational speed, which moment pivots the brake shoe from the rest position into the brake position, the moment which is generated by the frictional connection holding the brake shoe in the brake position and pressing it into the brake position.

The brake is active for as long as the cable remains without load. In the case of a tension on the cable as a result of a suspended load, the brake is released automatically.

The above-described emergency braking operations are provided for the case where, for example, the load is detached from the cable. In this case, the counterforce for the equilibrium position is absent for that piston of the balancer which is loaded with gas pressure, with the result that the piston is suddenly displaced axially by the gas pressure prevailing on it and the cable drum is set in rapid rotation. Without emergency braking, the cable end would be accelerated greatly as a result, with the consequence that it would lash out and lead to injuries or damage.

To this extent, the above-described emergency braking operations are appropriate and necessary. However, the construction of said emergency braking operations does not allow for the circumstance that only part of the load hanging on the cable comes free under some circumstances. If, for example, a comparatively heavy load hook is still hooked onto the cable, the abrupt braking of the cable can lead, on account of the forces of inertia of the load hook, to the load hook skipping on the cable and introducing jolts into the cable. A moment would then be introduced into the cable drum in the opposite rotational direction, with the result that the brake device would disengage. Owing to a lack of a corresponding counterforce, the cable end would again be accelerated by the excess pressure which still prevails in the balancer.

The invention is therefore based on the object of improving a balancer of the type stated in the introduction in this regard.

The object is achieved by a balancer for raising, holding and lowering a load, comprising a cable drum which is actuated by pressure medium and has a cable for bearing the load, which cable can be unwound from and wound onto said cable drum, and has a device for emergency braking of the cable drum if a defined rotational speed is exceeded, which device for emergency braking comprises at least one locking element which is fastened to the cable drum, is held in a freewheeling position in a spring-loaded manner and can be moved into a deployed locking position in a manner which is actuated by centrifugal force, in which locking position the rotation of the cable drum is blocked by virtue of the fact that the locking element is in engagement with a stop which is stationary relative to the cable drum, the balancer being distinguished in that, after its triggering, the locking element is held in a deployed position when said locking element and the stop which interacts with it move out of engagement.

The invention can be summarized to the effect that the balancer according to the invention comprises a device for emergency braking which comprises at least one locking element which can be deployed in a manner actuated by centrifugal force and, after triggering, remains in the locking position regardless of the rotational direction of the torque which is exerted on the cable drum. Here, the device for emergency braking is configured in such a way that, although the locking element can disengage briefly from an associated stop, the locking action is not canceled in principle as a result.

In the context of the invention, disengaged means that the locking element does not necessarily have to be in contact with or bear against the associated stop.

The balancer according to the invention can comprise a cable drum, which can be displaced along its rotational axis, and a ball screw mechanism which converts an axial movement of a piston which is loaded by gas pressure into a rotation and axial movement of the cable drum. Here, the axial displacement of the cable drum is expediently dimensioned in such a way that, during winding up and unwinding, the cable exits at one point from the enclosing housing which surrounds the cable drum.

In one preferred variant of the balancer according to the invention, the locking element is held in the deployed position in a spring-loaded state. After the device for emergency braking has been triggered, it is necessary to perform an unlocking operation by corresponding manual actuation, in order to recommission the balancer.

The invention is to be understood in principle such that the device for emergency braking can be triggered independently of the rotational direction of the cable drum if a predefined limiting rotational speed is exceeded. The locking element which can be deployed in a manner actuated by centrifugal force can also, for example, be provided such that it is restored automatically into an unlocked position only when the cable drum is situated in a predefined position, for example at one of the end stops, in which the cable is either unwound completely or is wound up completely.

As an alternative, it can be provided that a manually actuated unlocking operation is possible only in one of said end positions.

In one expedient refinement of the balancer according to the invention, it is provided that the locking element is configured as a locking lever which can be pivoted on one side and can be moved, in a manner which is actuated by centrifugal force, from a pivoted-in freewheeling position into a radially deployed locking position.

According to the invention, the device for emergency braking can of course comprise a plurality of locking levers which are arranged, for example, on a common radius with respect to the cable drum.

The locking element can preferably be pivoted in each case about a rotational axis which extends approximately parallel to the rotational axis of the cable drum.

In one expedient variant of the balancer according to the invention, it is provided that a retaining spring is attached to the locking element at a spacing from the pivot pin of the latter, in such a way that the retaining spring holds the triggered locking element in the deployed position if the locking element is deflected beyond a predefined dead center position.

It is particularly advantageous if said retaining spring also holds the locking element in the freewheeling position in a non-actuated manner.

In one particularly advantageous refinement of the balancer according to the invention, it is provided that the device for emergency braking comprises, furthermore, at least one centrifugal lever which is articulated pivotably on the cable drum and which acts on the locking element in an actuating manner. The centrifugal lever can be held, for example, via the locking element in a pivoted-in position. If a defined rotational speed of the cable drum is exceeded which is dependent on the magnitude of the retaining force of the retaining spring, the centrifugal lever is deflected radially outward and presses the locking lever into the deployed position counter to the spring force. Here, the locking element is attached to the retaining spring in such a way that, if a dead center position is passed, the locking element would experience a further pivoting movement into the completely pivoted-out position only on account of the spring force. The locking element is then held in this position via the restoring spring.

If a plurality of locking elements are provided, each locking element can be assigned a centrifugal lever.

To this end, it is expedient if, in the freewheeling position, the centrifugal lever and the locking element extend approximately tangentially with respect to the rotational axis of the cable drum on a circumference of the cable drum and, in the case of a deflection, perform a pivoting movement in the opposite direction.

The cable drum can be arranged, for example, rotatably and/or axially displaceably within a stationary cage or a cylinder and, in the deployed position, the locking element can engage into locking apertures of the cage or cylinder. As an alternative, in the deployed position, the locking element can also engage into ribs or grooves of a cage or cylinder or else into ribs or grooves of the balancer housing.

In one expedient variant of the balancer according to the invention, it is provided that the device for emergency braking the cable drum is arranged on an end side of the cable drum, preferably on a mounting plate which is provided for this purpose.

Figure 2:
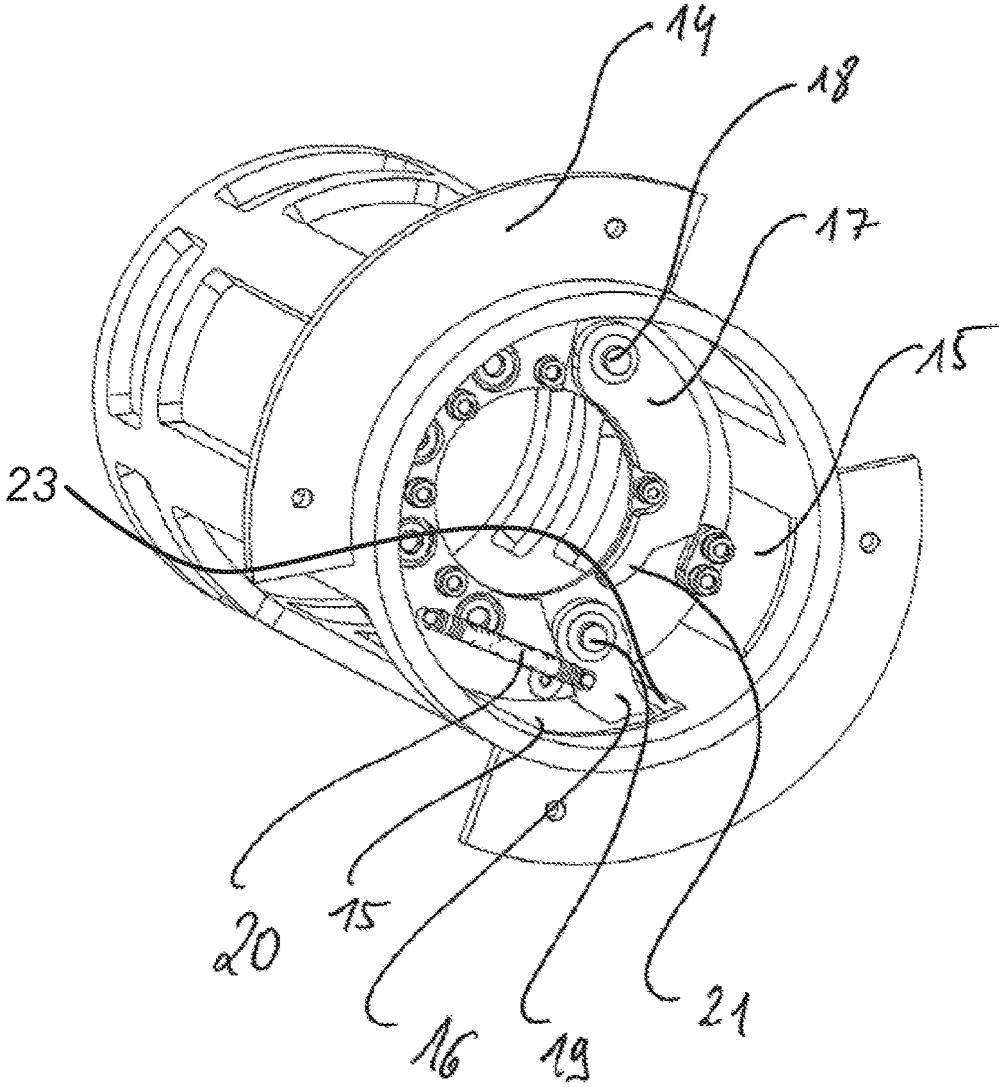
Figures 2B, 3A, 3C:
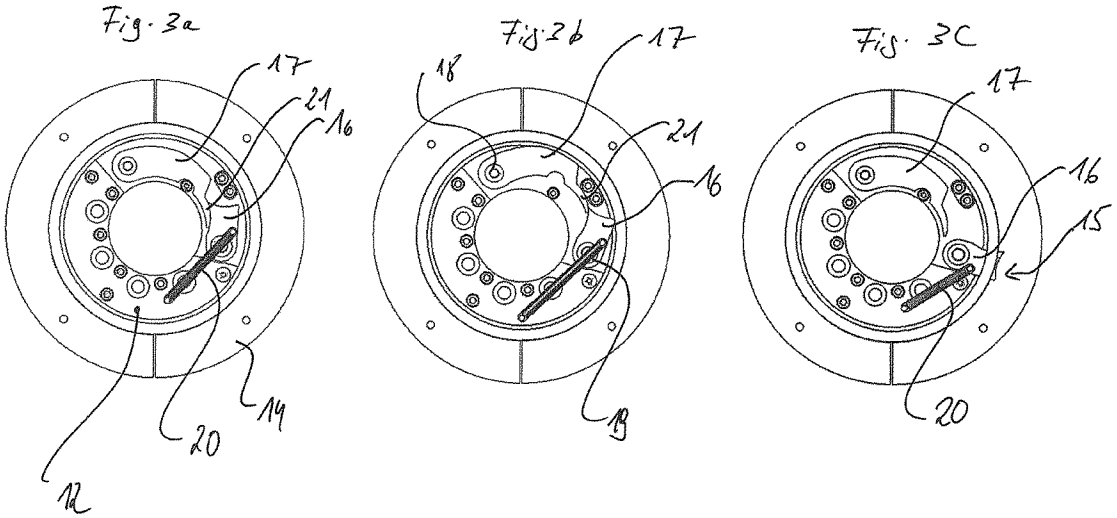

In the following text, the invention will be explained with reference to the appended drawings, in which:

FIG. 1 shows a longitudinal section through the balancer according to the invention, FIG. 2 shows a perspective illustration of the cage which surrounds the cable drum, and of the device for emergency braking of the cable drum in its position with regard to the cage, and FIGS. 3*a*-3*c* in each case show end views of the cable drum with the device for emergency braking, which figures in each case illustrate different states of the locking element and the centrifugal lever.

Reference is made first of all to FIG. 1. Said figure shows a balancer 1 as compressed air balancer in longitudinal section. The balancer 1 comprises a cylindrical housing 2 and connection covers 3 which are mounted on the housing 2 on the end side. An axle 4 which is arranged fixedly in terms of rotation and is configured partially as a ball bearing spindle 5 extends in the longitudinal center axis of the balancer 1. A spindle nut 6 which is connected fixedly to a cable drum 7 so as to rotate with it is arranged rotatably on the ball bearing spindle 5. A steel cable can be wound up onto and unwound from the cable drum. For reasons of simplicity, the steel cable is not shown in the drawing.

The housing 2 comprises a chamber 8 which is loaded with compressed air 22 and in which a piston 9 is arranged such that it can be displaced along the axle 4. The piston 9 is sealed by means of a circumferential sealing lip 10*a* against the enclosing wall of the cylindrical chamber 8. The piston 9 is sealed on the inner side against the axle 4 by way of a second sealing lip 10*b*. On its side which faces the cable drum, said piston 9 acts on the cable drum 7 via an axial ball bearing 11. The axial ball bearing 11 permits a relative rotation between the piston 9 and the cable drum 7. On account of the interaction of the stationary ball bearing spindle 5 or that part of the axle 4 which is configured as a ball bearing spindle 5 and the spindle nut 6 which is connected fixedly to the cable drum 7 so as to rotate with it, the cable drum 7 rotates about the axle 4 as a result of the axial displacement of the piston 9 and is at the same time displaced axially, to be precise by the extent to which a cable which is coiled onto the cable drum 7 is unwound or wound up.

Here, the lead of the ball roller track in the ball bearing spindle 5 is dimensioned in such a way that the cable which is coiled up on the cable drum always exits at the same point from a cable outlet opening which is provided for this purpose.

On that end side of the cable drum 7 which faces away from the piston 9, a mounting plate 12 is provided which is connected fixedly to the cable drum 7 so as to rotate with it. The cable drum 7 is centered within a cylindrical cage 13 which is arranged or flange-connected in a rotationally fixed manner within the housing.

A perspective illustration of the cage 13 can be seen from FIG. 2. Said cage 13 is of approximately cylindrical configuration and, on its side which faces the piston 9, is flange-connected to the housing 2 by way of a fastening flange 14. The circumferential face of the cage 13 is provided with a multiplicity of apertures 15 which, as will still be explained in the following text, interact with a locking element 16.

The locking element which is denoted by 16 and a centrifugal lever 17 are mounted in a pivotably movable manner on the mounting plate which is denoted by 12, is connected, as has been mentioned, fixedly to the end side of the cable drum 7 so as to rotate with it, is of approximately annular configuration and is inserted into the circumference of the cage 13. The pivot pins 18, 19 of the locking element 16 and of the centrifugal lever 17 extend approximately parallel to the axle 4 which at the same time defines the rotational axis of the cable drum 7.

The locking element 16 and the centrifugal lever 17 are arranged at a spacing on the circumference of the mounting plate 12 in such a way that the locking element 16 and the centrifugal lever 17 extend approximately tangentially with respect to a circular circumference. The pivoting movement which can be performed by the locking element 16 and by the centrifugal lever 17 in each case takes place in the opposite direction, the locking element 16 and the centrifugal lever 17 bearing approximately against the inner circumference of the annular mounting plate 12 in the freewheeling position of said locking element 16 and centrifugal lever 17. This position is shown, in particular, in FIG. 3*a*. In this position, the locking element 16 lies above the centrifugal lever 17, as viewed from the inside to the outside. In this position, the locking element 16 is held by a retaining spring 20. The retaining spring 20 likewise extends tangentially, in relation to the inner circumference of the mounting plate 12, or tangentially with respect to a circular circumference which extends concentrically to the axle 4. The retaining spring 20 is attached to the locking element 16 eccentrically at a spacing from the pivot pin 19, to be precise in such a way that, in the initial position which is shown in FIG. 3*a*, the locking element 16 is held via the retaining spring 20 in the pivoted-in position, that is to say experiences a moment about the pivot pin 19 counter to the clockwise direction (the rotational direction is in relation to the view in the figures) and experiences an opposed moment if the locking element 16 is pivoted radially outward via the dead center position. The dead center position is that position, in which both fastening points of the retaining spring 20 and the pivot pin 19 are arranged so as to be flush with one another. In the dead center position, an automatic restoring movement of the locking element 16 into the freewheeling position is no longer possible.

If the cable drum 7 then experiences, for example, a rotation counter to the clockwise direction, which rotation exceeds a defined rotational speed which is predetermined by the force of the retaining spring 2, the centrifugal lever 17 is likewise deflected counter to the clockwise direction. Here, the free end 21 of the centrifugal lever 17 presses the locking element 16 radially outward beyond the dead center point of the retaining spring 20, with the result that the locking element 16 engages in a locking manner into one of the apertures 15 with stop 23 of the cage 13. Here, the retaining spring 20 holds the locking element 16 in the radially deployed locking position. In the described exemplary embodiment, the device for emergency braking is configured as a securing means against unintentional winding up of the cable, and as an alternative can also be configured as a fall arrester.

As can be seen from FIG. 2, the locking element 16 arrests the cable drum 7 counter to the clockwise direction (in relation to the view in FIG. 2). In the case of a correspondingly mirror-inverted design of the arrangement of locking lever 16 and centrifugal lever 17, arresting of the rotation in the clockwise direction would be possible.

An unlocking action is possible only in the case of a correspondingly manually actuated restoring of the locking element 16.

The chamber 8 of the balancer 1 is loaded with compressed air via a pressure medium connection (not shown). The pressure within the chamber 8 is approximately in equilibrium with the force which is exerted on the piston 9 via the axial ball bearing 11 by the cable drum 7 if a load is suspended. A movement of the cable drum 7 takes place via a control operation of the pressure loading of the chamber 8 which brings about an axial movement of the piston 9 and a rotation of the cable drum 7 about its axis. In the process, the cable (not shown) is wound up and unwound. In the case of sudden loss of the load, this force equilibrium is disrupted such that the cable drum 7 exceeds a defined limiting rotational speed. As a result, a deflection of the centrifugal lever 17 about the pivot pin 18 and therefore also a deflection of the locking element 16 about the pivot pin 19 are brought about. The rotational speed and/or centrifugal force, at which a deflection of this type is possible is dependent on the characteristic of the retaining spring 20 and the mass of the centrifugal lever 17.

LIST OF DESIGNATIONS

1 Balancer
2 Housing
3 Connection cover
4 Axle
5 Ball bearing spindle
6 Spindle nut
7 Cable drum
8 Chamber
9 Piston
10*a, b* Sealing lips
11 Axial ball bearing
12 Mounting plate
13 Cage
14 Fastening flange
15 Apertures
16 Locking element
17 Centrifugal lever
18 Pivot pin
19 Pivot pin
20 Retaining spring
21 Free end of the centrifugal lever

What is claimed is:

1. A balancer for raising, holding and lowering a load, comprising:

a cable drum actuatable by a pressure medium, a cable for bearing the load, the cable being unwindable from and windable onto said cable drum, a device for emergency braking of the cable drum if a defined rotational speed of the cable drum is exceeded, wherein the device for emergency braking comprises at least one triggerable locking element fastened to the cable drum, the locking element movable from in a freewheeling position to a deployed locking position actuatable by centrifugal force, in which deployed locking position a rotation of the cable drum is blocked by the locking element being in engagement with a stop which is stationary relative to the cable drum, wherein, before being triggered, the locking element is held in the freewheeling position by a retaining spring and movement from the freewheeling position towards the deployed locking position is biased by the retaining spring, wherein, after being triggered, the locking element is held in the deployed locking position by the retaining spring and movement from the deployed locking position towards the freewheeling position is biased by the retaining spring, and wherein the cable drum is arranged rotatably and/or axially displaceably within a stationary cage or a stationary cylinder or a stationary housing, and in that, in the deployed locking position after being triggered, the locking element engages into a locking aperture of the stationary cage or the stationary cylinder or the stationary housing.

2. The balancer as claimed in claim 1, wherein the retaining spring is attached to the locking element at a spacing from a pivot pin of the locking element, wherein, when the locking element is in the freewheeling position, the retaining spring is arranged to bias pivoting of the locking element about the pivot pin towards the deployed locking position, and wherein, when the locking element is in the deployed locking position, the retaining spring is arranged to bias pivoting of the locking element about the pivot pin towards the freewheeling position.

3. The balancer as claimed in claim 1, wherein the locking element comprises a pivotable locking lever which is movable by centrifugal force from the freewheeling position to the deployed locking position.

4. The balancer as claimed in claim 1, wherein the retaining spring is attached to the locking element at a spacing from a pivot pin of the locking element, wherein the retaining spring holds the locking element in the deployed locking position if the locking element is deflected beyond a dead center position.

5. The balancer as claimed in claim 4, wherein the retaining spring holds the locking element in the freewheeling position in a non-actuated manner.

6. The balancer as claimed in claim 1, wherein the device for emergency braking comprises, furthermore, at least one centrifugal lever which is articulable pivotably on the cable drum and which acts on the locking element in an actuating manner.

7. The balancer as claimed in claim 6, wherein the centrifugal lever is held via the locking element in a pivoted-in rest position.

8. The balancer as claimed in claim 6, wherein, in the freewheeling position, the centrifugal lever and the locking element extend approximately tangentially with respect to the axis of the cable drum on a circumference of the cable drum and, upon deflection, perform a pivoting movement in the opposite direction.

9. The balancer as claimed in claim 1, wherein the device for emergency braking of the cable drum is provided on an end side of the cable drum.

10. A balancer for raising, holding and lowering a load, comprising:

a cable drum actuatable by a pressure medium, a cable for bearing the load, the cable being unwindable from and windable onto said cable drum, a device for emergency braking of the cable drum if a defined rotational speed of the cable drum is exceeded, wherein the device for emergency braking comprises at least one triggerable locking element fastened to the cable drum, the locking element movable from a freewheeling position to a deployed locking position actuatable by centrifugal force, in which deployed locking position a rotation of the cable drum is blocked by the locking element being in engagement with a stop which is stationary relative to the cable drum, wherein, before being triggered, the locking element is held in the freewheeling position by a retaining spring and movement from the freewheeling position towards the deployed locking position is biased by the retaining spring, wherein, after being triggered, the locking element is held in the deployed locking position by the retaining spring and movement from the deployed locking position towards the freewheeling position is biased by the retaining spring, wherein, after being triggered, the rotation of the cable drum is blocked by the locking element being in positive mechanical engagement with the stop, and wherein the cable drum is arranged rotatably and/or axially displaceably within a stationary cage or a stationary cylinder or a stationary housing, wherein the stationary cage or the stationary cylinder or the stationary housing provides the stop.

11. The balancer as claimed in claim 10, wherein the retaining spring is attached to the locking element at a spacing from a pivot pin of the locking element, wherein, when the locking element is in the freewheeling position, the retaining spring is arranged to bias pivoting of the locking element about the pivot pin towards the deployed locking position, and wherein, when the locking element is in the deployed locking position, the retaining spring is arranged to bias pivoting of the locking element about the pivot pin towards the freewheeling position.

12. The balancer as claimed in claim 10, wherein the locking element comprises a pivotable locking lever which is movable by centrifugal force from the freewheeling position to the deployed locking position.

13. The balancer as claimed in claim 10, wherein the retaining spring is attached to the locking element at a spacing from a pivot pin of the locking element, wherein the retaining spring holds the locking element in the deployed locking position if the locking element is deflected beyond a dead center position.

14. The balancer as claimed in claim 13, wherein the retaining spring holds the locking element in the freewheeling position in a non-actuated manner.

15. The balancer as claimed in claim 10, wherein the device for emergency braking comprises, furthermore, at least one centrifugal lever which is articulable pivotably on the cable drum and which acts on the locking element in an actuating manner.

16. The balancer as claimed in claim 15, wherein the centrifugal lever is held via the locking element in a pivoted-in rest position.

17. The balancer as claimed in claim 15, wherein, in the freewheeling position, the centrifugal lever and the locking element extend approximately tangentially with respect to the axis of the cable drum on a circumference of the cable drum and, upon deflection, perform a pivoting movement in the opposite direction.

18. The balancer as claimed in claim 10, wherein the device for emergency braking of the cable drum is provided on an end side of the cable drum.

* * * * *